US007972120B2

(12) United States Patent
Fagotti

(10) Patent No.: US 7,972,120 B2
(45) Date of Patent: Jul. 5, 2011

(54) DISCHARGE SYSTEM FOR COMPRESSORS

(75) Inventor: Fabian Fagotti, Joinville-SC (BR)

(73) Assignee: Whirlpool S.A., Sao Paulo -Sp (BR)

( * ) Notice: Subject to any disclaimer, the term of this patent is extended or adjusted under 35 U.S.C. 154(b) by 119 days.

(21) Appl. No.: 10/596,685

(22) PCT Filed: Dec. 21, 2004

(86) PCT No.: PCT/BR2004/000250

§ 371 (c)(1),
(2), (4) Date: Aug. 7, 2006

(87) PCT Pub. No.: WO2005/061892

PCT Pub. Date: Jul. 7, 2005

(65) Prior Publication Data

US 2007/0201990 A1 Aug. 30, 2007

(30) Foreign Application Priority Data

Dec. 23, 2003 (BR) ..... PI0306180-9

(51) Int. Cl.
*F04B 39/00* (2006.01)
*F04B 53/00* (2006.01)

(52) U.S. Cl. ..... 417/312

(58) Field of Classification Search ..... 417/312
See application file for complete search history.

(56) References Cited

U.S. PATENT DOCUMENTS

| | | | | |
|---|---|---|---|---|
| 5,173,034 | A * | 12/1992 | Riffe | 417/312 |
| 6,547,536 | B2 * | 4/2003 | Seo | 417/312 |
| 2002/0071774 | A1 * | 6/2002 | Lee | 417/312 |
| 2002/0136646 | A1 * | 9/2002 | Seo | 417/312 |
| 2002/0141885 | A1 * | 10/2002 | Seo | 417/312 |

FOREIGN PATENT DOCUMENTS

| | | | |
|---|---|---|---|
| DE | 39 32 299 | A1 | 4/1991 |
| DE | 40 41 439 | A1 | 6/1992 |
| GB | 1017564 | | 1/1966 |
| WO | WO 99/53200 | A1 | 10/1999 |

OTHER PUBLICATIONS

International Search Report for International Application No. PCT/BR2004/000250, dated mailed Apr. 5, 2005.

* cited by examiner

*Primary Examiner* — Devon C Kramer
*Assistant Examiner* — Peter J Bertheaud
(74) *Attorney, Agent, or Firm* — Gifford, Krass, Sprinkle, Anderson & Citkowski, P.C.

(57) ABSTRACT

A discharge system for a compressor which includes a first plurality of discharge chambers connected to provide a serial discharge from the compression chamber of the compressor to an outlet and a second set of discharge chambers providing a parallel discharge path from the compression chamber of the compressor to the outlet upon the pressure in the compression chamber exceeding a predetermined value.

3 Claims, 3 Drawing Sheets

DISCHARGE SYSTEM FOR COMPRESSORS

FIELD OF THE INVENTION

The present invention refers to a discharge system to be applied to compressors in general and, more particularly, to compressors used in refrigeration systems and which can be of the reciprocating hermetic type, for example.

BACKGROUND OF THE INVENTION

Compressors for refrigeration are generally provided with a discharge muffler. Such muffler has the purpose of attenuating the pulsation of the gases which are pumped from the compressor to the refrigeration system, or generally, to the high-pressure side of the circuit to which the compressor belongs, as well as reducing the noise irradiated by the compressor to the external ambient. The pulsation of the gases generates an excitation in the ducts and components to which the discharge of the compressor is coupled, leading to the always undesired generation of noise. Several configurations are used for said muffler, but in general the principle is to make the gas flow pass through a well defined sequence of tubes, volumes and localized restrictions, whose dimensions, arrangement and specific characteristics depend on the application, on the type and size of the compressor, on the mass flow, on the working fluid, on the temperatures and operating conditions, on the noise bands which are intended to attenuate, etc.

The following facts are relevant to understand the phenomena involved in the operation of the object of this description:

- Before starting the operation, the compressor is generally submitted to a null or reduced pressure differential between the suction and the discharge. This common pressure is called equalizing pressure and its value is a direct function of the project characteristics of the system, of the type of refrigerant fluid and lubricant fluid that are used, and of the temperatures to which the refrigeration system is submitted. Since there is not a relevant pressure differential between the suction and discharge, the mass flow which is established in the initial instants of the compressor operation is always very high, usually one order of magnitude above the mass flow in a normal operating regime. The higher the density of the working fluid, the higher the value of the mass flow, i.e., the greater the value of the equalized pressure and the lower the fluid temperature, the greater the value of the mass flow.
- Even in systems in which devices are provided to maintain the pressure differential, with the compressor being in a stop condition, the mass flow is naturally greater during the compressor start;
- The tubes and localized restrictions existing in the discharge muffler cause load loss to the working fluid flow, whose variation is, in a first approach, linear with the mass flow;
- The power required from the motor of the compressor is the sum of the powers required to overcome the friction forces which appear upon the movement of the driving mechanism plus the powers which are necessary to compress and pump the gas. This last power part corresponds, in a no-load starting condition, to the flow load loss. In a normal operating condition, the mass flow is such that the power needed to pump the gas is low, as compared to the other parts. However, in a starting condition, the power dissipated for pumping the gas is much greater than the other power parts.

- The compressor components are, as a rule, designed to give maximum efficiency when said compressor operates in the normal operating regime. In the case of the motor, there is a negative correlation between the maximum available power and maximum efficiency. The same is true to the maximum available power and motor cost. Thus, it is always interesting to reduce at maximum the requirement for maximum motor power, which is correlated with operating conditions with high mass flow or, as a rule, upon the compressor start.

In view of the facts exposed above, there is a compromise relationship between the project of the motor and the project of the discharge muffler. The latter implies, intrinsically, a restriction to the gas flow (load loss), which restriction increases as the mass flow increases. If this load loss is reduced, the maximum power required from the motor will be less strict, which means a project with the possibility of obtaining higher efficiencies and/or lower costs.

FIGS. 1 and 2 show, schematically, two other known prior art constructions for the discharge muffler, one of them (FIG. 1) presenting a solution for a discharge muffler arranged "in series", and the other construction (FIG. 2) presenting a solution for a muffler arranged "in parallel".

The solution of the discharge system with the arrangement "in series" presents the disadvantage of having higher load loss but higher attenuation, whereas the solution with the arrangement in parallel presents lower restriction to the flow between the volume of the cylinder cover and the volumes of the muffler, but lower noise attenuation.

OBJECT OF THE INVENTION

Thus, it is an object of the present invention to provide a discharge system for compressors, generally refrigeration compressors, which does not present load loss in any load flow conditions, mainly in those of high load flow such as in the motor start, without impairing the attenuation of noise and pulsation.

SUMMARY OF THE INVENTION

This and other objects are attained by a discharge system for compressors of the type which comprises: a cylinder block defining a compression chamber; a first discharge chamber receiving an intermittent gas mass flow from the compression chamber; a second discharge chamber in direct communication with the first discharge chamber; a third discharge chamber in constant fluid communication with the second discharge chamber and opened to a discharge tube, said discharge chamber comprising a valve means which assumes an open position, communicating the first and the third discharge chambers when a gas mass flow passing from the compression chamber to the first discharge chamber reaches a determined gas mass flow value, and a closed position blocking, at least in most part, said fluid communication between the first and the third discharge chambers when said gas mass flow reaches values that are lower than the determined gas mass flow value.

BRIEF DESCRIPTION OF THE DRAWINGS

The invention will be described below, with reference to the enclosed drawings, in which.

DETAILED DESCRIPTION OF THE INVENTION

Figure 1:
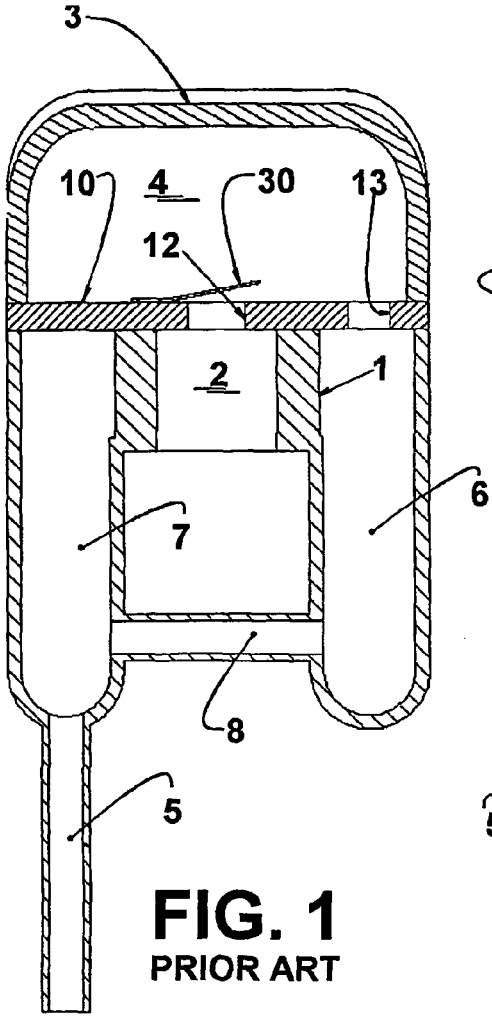
FIG. 1 PRIOR ART
FIG. 1 illustrates, schematically, a longitudinal sectional view of part of the cylinder block and cylinder head of a refrigeration hermetic compressor, showing an arrangement of a discharge system "in series", according to the prior art.

The present invention will be described for a generally hermetic refrigeration compressor of the type which comprises, inside a shell (not illustrated), a motor-compressor assembly including a cylinder block within which a cylinder 1 lodges a piston (not illustrated) reciprocating inside the cylinder 1, drawing and compressing the refrigerant gas when driven by the electric motor of the compressor.

The cylinder 1 presents an open end, which is closed by a valve plate 10 affixed to the cylinder block and provided with at least one suction orifice 11 and one discharge orifice 12. The cylinder 1 defines 2, with its walls, the piston top and the valve plate 10, a compression chamber.

The valve plate 10 carries at least one suction valve 21 and a discharge valve 30 which operate close to the respective suction orifice 11 and discharge orifice 12, respectively.

Figure 5:
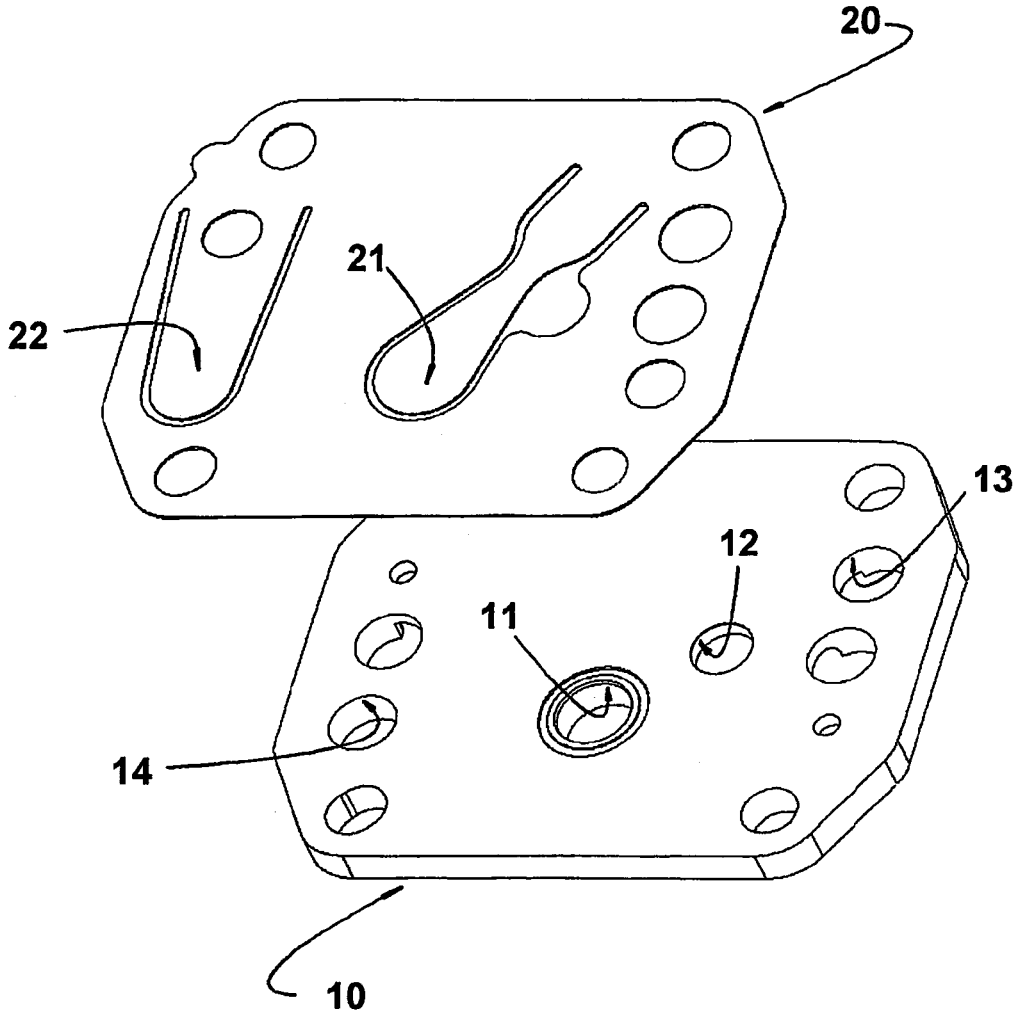
FIG. 5 illustrates, schematically and in a perspective view, a construction for a valve blade and a valve plate constructed according to the present invention.

According to a constructive form illustrated in FIG. 5, the suction valve 21 is incorporated to a valve blade 20, mounted to the valve plate 10. In the illustrated construction, the valve plate 10 presents a suction orifice 11 which is selectively closed by a respective suction valve 21 provided in the form of a vane incorporated to the valve blade 20.

The cylinder block further carries a cylinder head 3, affixed onto the valve plate 10 in order to separate the high pressure side from the low pressure side, and defines, internally, a suction chamber (not illustrated) and a first discharge chamber 4 which are maintained in selective fluid communication with the compression chamber 2 upon the operation of respective suction valve 21 and discharge valve 30 actuating in respective suction orifices 11 and first discharge orifice 12, so as to receive an intermittent gas mass flow from said compression chamber 2.

The shell further carries a discharge tube 5, presenting an internal end opened to the first discharge chamber 4 and an opposite end (not illustrated) which is opened to an orifice provided in the surface of the shell, communicating said first discharge chamber 4 and the compression chamber 2 with the high pressure side of a system to which the compressor is connected.

In a prior art construction illustrated in FIG. 1, the gas mass flow compressed in the compression chamber 2 is directed, upon the opening of the discharge valve 30, to the first discharge chamber 4, which can be considered as a first component of a discharge muffler. The gas mass flow is then conducted to the high pressure side of the system to which the compressor is connected, through a second discharge chamber 6 maintained in a direct and constant fluid communication with the first discharge chamber 4, through a constantly open second discharge orifice 13 provided in the valve plate 10 and which is dimensioned to provide a determined flow rate for the gas mass which is compressed to the second discharge chamber 6. The second discharge chamber 6 also maintains a constant fluid communication with a third discharge chamber 7 provided in the cylinder block 1 through a fluid communication means defined by a gas passage 8, said third discharge chamber 7 being opened to the discharge tube 5.

The second discharge chamber 6, the third discharge chamber 7, the gas passage 8 and the discharge tube 5 are also components of the discharge muffler.

The embodiment of FIG. 1 defines an arrangement "in series" for the gas flow discharge, in which the whole gas mass flow passes from the compression chamber 2 to the first discharge chamber 4 through the first discharge orifice 12, and from said first discharge chamber 4 to the second discharge chamber 6 through the second discharge orifice 13, said gas flow being directed to the third discharge chamber 7 through the gas passage 8, then reaching the discharge tube 5 through which it is conducted to the exterior of the compressor.

Figure 2:
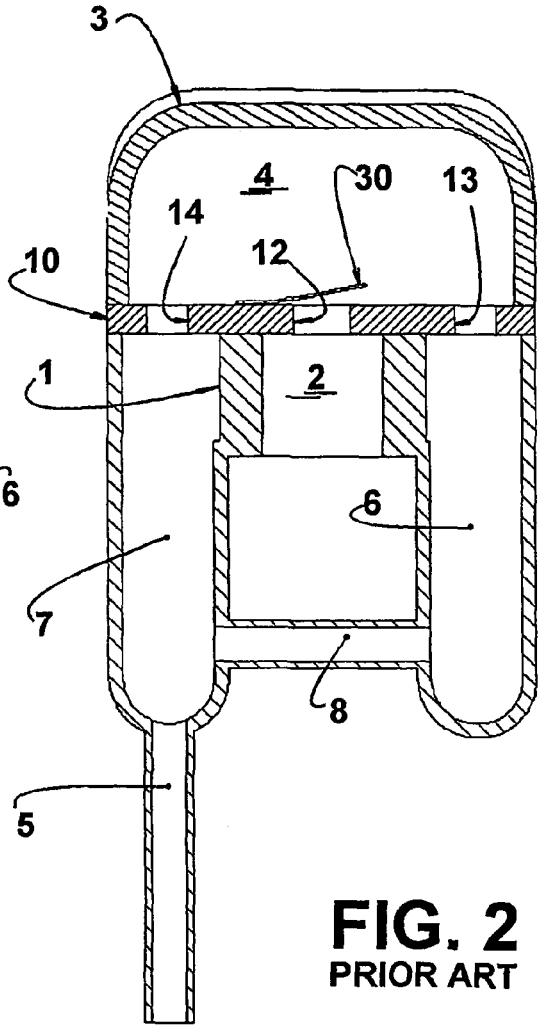
FIG. 2 PRIOR ART
FIG. 2 illustrates, schematically, a longitudinal sectional view of part of the cylinder block and cylinder head of a refrigeration hermetic compressor, showing another arrangement of a discharge system "in parallel", according to the prior art.

In another prior art constructive form illustrated in FIG. 2 and defined as an arrangement "in parallel", the third discharge chamber 7 maintains a direct and constant fluid communication with the first discharge chamber 4 through a third discharge orifice 14. In this embodiment, the gas mass flow discharged by the compression chamber 2 to the first discharge chamber 4 is divided in two streams, one stream passing through the third discharge orifice 14 to the third discharge chamber 7 and therefrom directly to the discharge tube 5, whereas the other stream continues, passing through the second discharge orifice 3 to the second discharge chamber 6 and therefrom to the discharge tube 5, as previously described for the arrangement "in series". These constructions present the disadvantages already discussed above.

The present invention provides a discharge system which allows, with the same construction, two different gas discharge conditions which are defined as a function of the gas mass flow established during discharge from the compression chamber 2 to the first discharge chamber 4. One of the gas discharge conditions is defined in normal mass flow conditions, whereas the other condition is defined when there is a high mass flow, as described ahead.

According to the present invention, the discharge system comprises a valve means 22 which assumes an open position, communicating the first discharge chamber 4 with the third discharge chamber 7 when a gas mass flow from the compression chamber 2 to the first discharge chamber 4 reaches a determined gas mass flow value, and a closed position, blocking at least in most part, said fluid communication between the first discharge chamber 4 and the third discharge chamber 7 when said gas mass flow reaches values which are lower than the determined gas mass flow value. In the closed position, the valve means 22 blocks, preferably totally, the direct fluid communication between the first discharge chamber 4 and the third discharge chamber 7. However, the system may work with a construction in which said fluid communication blockage is not total, but almost total.

Figure 3:
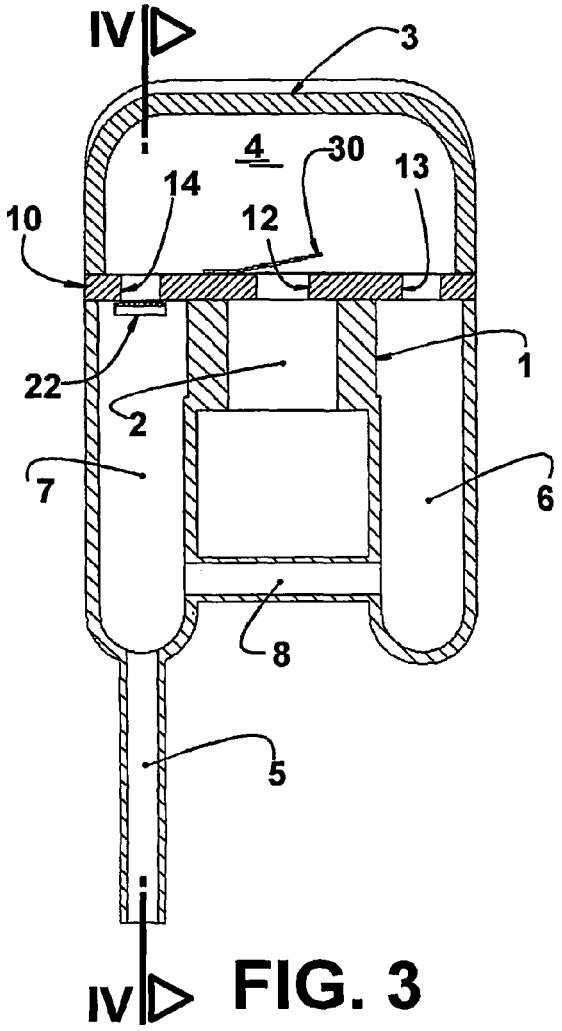
FIG. 3 illustrates, schematically, a longitudinal sectional view of part of the cylinder block and cylinder head of a refrigeration hermetic compressor, showing a discharge system configured according to the present invention.
Figure 4:
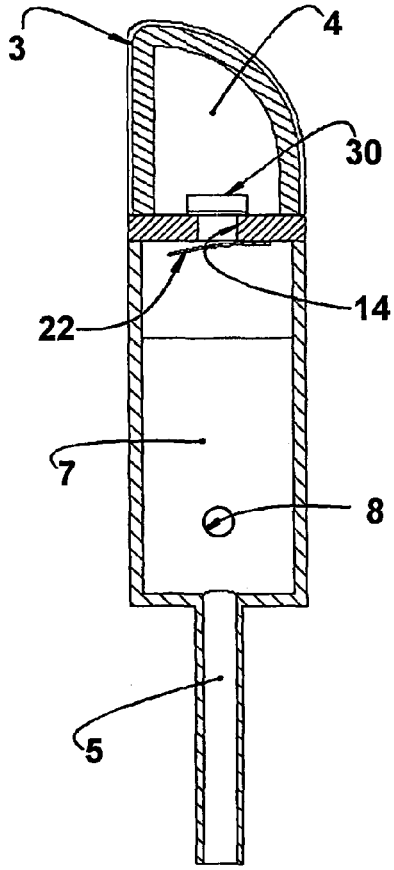
FIG. 4 illustrates, schematically, a longitudinal sectional view, according to line IV-IV of FIG. 3.

In accordance with the illustrations of FIGS. 3 and 4, the valve means 22 is disposed in the third discharge orifice 14 provided in the valve plate 10 between the first discharge chamber 4 and the third discharge chamber 7.

In a form of accomplishing the present invention, the valve means 22 is in the form of a blade valve mounted to the valve plate 10, for example incorporated to the valve blade 20 which is affixed to the valve plate 10, as illustrated in FIG. 5.

In a constructive variant of the present solution, said valve means 22 is incorporated to a valve blade other than that incorporating the suction valve 21.

The open position of the valve means 22 allows establishing, in an arrangement "in parallel", the direct passage of the gas flow from the compression chamber 4 to the first discharge chamber 4 and to the third discharge chamber 7. In this arrangement, the restriction to the flow between the volume of the first discharge chamber 4 and the other second and third discharge chambers 6, 7 is reduced. By establishing a more direct path to the passage of the gas mass flow, the load loss is reduced. In order to comply with the commitment relationship mentioned above, the opening of the valve means 22 should occur only in specific conditions, i.e., only when there is a high mass flow. The correlation between the design of the valve means, its thickness, the existence or not of a pre-tension and the design of the orifices covered thereby will determine the pressure at which the opening occurs. In a normal operating regime of the compressor, the valve means 22 must remain closed, which results in a gas flow passing only or substantially only through the second discharge chamber 6, which arrangement is the one previously defined as "in series", in which the mass flow follows the normal path defined by the muffler, attenuating noise and pulsation with higher acoustic efficiency. Since there is a direct correlation between the mass flow and load loss (or pressure differential), in order to minimize the occurrence of such losses, the valve means 22 of the present solution operates as a function of the pressure differential to which it is submitted. Thus, when the mass flow is high, reaching a determined value which establishes a high pressure differential, the valve means 22 opens, reducing the power required from the motor in this situation and enabling to optimize the project thereof, resulting in lower load loss and more efficient acoustic attenuation. In this case, the discharge system of the present invention actuates in the same way as the arrangement "in parallel" described above. Thus, less power is required from the motor in the compressor start, without increasing noise and pulsation in normal operating conditions. On the other hand, when the mass flow is low, i.e., presents a value which is lower than the determined mass flow value, as it occurs in normal operating conditions of the compressor, the valve means 22 must remain closed, forcing the mass flow to pass through all components of the muffler. The closed condition of the valve means 22 results in higher restriction and higher acoustic attenuation during the gas discharge.

The valve means 22 can be constructed in such a way as to be maintained tensioned on the third discharge orifice 14, i.e., with a negative pre-tension force. The modulus of this force should be greater than the force resulting from the pressure differential established between the first discharge chamber 4 and the third discharge chamber 7 in normal operating conditions of the compressor. In higher mass flow conditions, this pressure differential tends to increase, resulting in a force exerted on the valve means 22 until the latter reaches a value greater than the pre-tension imparted by the construction of said valve means 22 and which causes the latter to open, allowing the passage of the mass flow to the third discharge chamber 7. In this condition, the load loss of the gas flow and consequently the power required from the motor are minimized.

The invention claimed is:

1. A discharge system for compressors comprising: a cylinder block defining a compression chamber;

a first discharge chamber receiving an intermittent gas mass flow from the compression chamber;

a second discharge chamber in direct communication with the first discharge chamber;

a third discharge chamber connecting with the second discharge chamber and an outlet connected to the third discharge chamber; whereby a first discharge path is provided by a serial connection between the compression chamber and the outlet through the first discharge chamber, the second discharge and the third discharge chamber;

a valve provided directly between the first discharge chamber and the third discharge chamber, said valve being operable to open upon a predetermined pressure being produced in the first discharge chamber to open communication between the first discharge chamber and the third chamber thereby creating a second parallel discharge path through the first discharge chamber, the third discharge chamber and the outlet.

2. The discharge system as defined in claim 1 and including a connection between the second discharge chamber and the third discharge chamber so that flow is open between the second discharge chamber and the third discharge chamber.

3. The discharge system as defined in claim 1 and including a discharge tube connected with the third discharge chamber.

* * * * *